US005240899A

United States Patent [19]

Bowman et al.

[11] Patent Number: 5,240,899

[45] Date of Patent: Aug. 31, 1993

[54] SLIPPING LAYER BINDER FOR DYE-DONOR ELEMENT USED IN THERMAL DYE TRANSFER

[75] Inventors: Wayne A. Bowman, Walworth; David P. Brust; Noel R. Vanier, both of Rochester, all of N.Y.

[73] Assignee: Eastman Kodak Company, Rochester, N.Y.

[21] Appl. No.: 932,439

[22] Filed: Aug. 19, 1992

[51] Int. Cl.[5] ..... B41M 5/035; B41M 5/38

[52] U.S. Cl. ..... 503/227; 428/195; 428/447; 428/480; 428/500; 428/913; 428/914

[58] Field of Search ..... 8/471; 503/227; 428/195, 447, 480, 500, 913, 914

[56] References Cited

U.S. PATENT DOCUMENTS 4,753,920 6/1988 Vanier ..... 503/227

*Primary Examiner*—Pamela R. Schwartz

*Attorney, Agent, or Firm*—Harold E. Cole

[57] ABSTRACT

A dye-donor element for thermal dye transfer comprising a support having on one side thereof a dye layer and on the other side a slipping layer comprising an aminoalkyl(dialkylsilyl)-terminated poly(dialkyl siloxane) in a polymeric binder, the improvement wherein said polymeric binder comprises a poly(vinyl acetal) having more than 60 mole % acetal units which is formed from poly(vinylalcohol) and acetaldehyde or formaldehyde.

20 Claims, No Drawings

SLIPPING LAYER BINDER FOR DYE-DONOR ELEMENT USED IN THERMAL DYE TRANSFER

This invention relates to dye donor elements used in thermal dye transfer, and more particularly to the use of a certain poly(vinyl acetal) binder for silicone-containing slipping layers on the back side thereof.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head, preventing donor transport. A slipping layer is typically provided to facilitate passage of the dye-donor under the thermal printing head. A defect in the performance of that layer causes intermittent rather than continuous transport across the thermal head. The dye transferred thus does not appear as a uniform area, but rather as a series of alternating light and dark bands (chatter marks).

U.S. Pat. No. 4,753,920 discloses certain polymeric binders, such as cellulose acetate propionate, for use with amino-modified silicones as a slipping layer for a thermal dye transfer element. While this slipping layer has been useful in a number of applications, some problems have developed with this slipping layer when it is used with certain newer thermal print heads such as TDK thermal Head LV5404A 1A0008, which employ an inexpensive, acid-sensitive, soft ceramic glaze over the heating elements of the heat. Such a ceramic glaze may contain lanthanum and nitrogen in addition to silicon and oxygen. One problem with the prior art slipping layers when used with these newer thermal print heads is a permanent build-up of debris on the head that cannot be removed by cleaning with organic solvents and which causes scratches in the printed copy. In addition, without frequent cleaning of the heating line, these slipping layers can cause corrosion of the glaze by producing acidic products on heating which can attack the ceramic glaze and can also lead to build-up of debris on the head.

It is an object of this invention to eliminate or reduce the above problems. It is another object of this invention to provide a slipping layer which has lower friction when compared to other prior art slipping layers.

These and other objects are achieved in accordance with this invention which comprises a dye-donor element for thermal dye transfer comprising a support having on one side thereof a dye layer and on the other side a slipping layer comprising an aminoalkyl(dialkylsilyl)-terminated poly(dialkyl siloxane) in a polymeric binder, the improvement wherein the polymeric binder comprises a poly(vinyl acetal) having more than 60 mole % acetal units which is formed from poly(vinylalcohol) and acetaldehyde or formaldehyde.

In a preferred embodiment of the invention, the aminoalkyl(dialkylsilyl)-terminated poly(dialkyl siloxane) has the following formula:

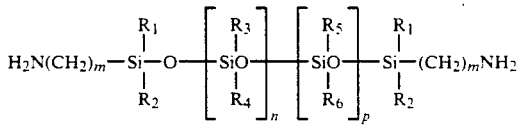

where m is from 3 to 6, n is from 10 to 2,000, p is from 0 to about 2,000 and $R_1$–$R_6$ are alkyl groups having from 1 to about 6 carbon atoms. In another preferred embodiment, $R_1$–$R_6$ are each methyl, m is 3 and p is 0. This material is supplied commercially from Petrarch Systems, Inc. as PS513.

In another preferred embodiment of the invention, the aminoalkyl(dialkylsilyl)-terminated poly(dialkyl siloxane) is a T-structure poly(dimethyl siloxane) with an aminoalkyl functionality at the branchpoint, such as one having the following formula:

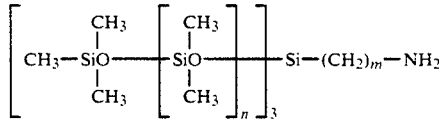

where m is from 1 to 10 and n is from 10 to 1000. This material is supplied commercially from Petrarch Systems, Inc. as PS054.

In another preferred embodiment of the invention, the slipping layer also contains another siloxane which is a copolymer of a polyalkylene oxide and a methylalkylsiloxane, such as a copolymer of polypropylene oxide and poly(methyl octyl siloxane), such as BYK 320 (50% in Stoddard solvent) or BYK S732 (98% in Stoddard solvent) from BYK Chemie, USA.

The poly(vinyl acetal) employed in this invention is composed of at least 60 mole % acetal units with the balance being predominantly vinyl alcohol units. Poly(vinyl acetal) has the following structure:

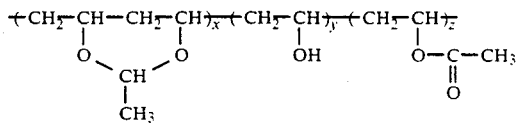

wherein x + y + z = 100 (mole %).

The component mers can be varied widely to give a polymer termed a poly(vinyl acetal). The optimal material is high in acetal units and low in vinyl acetate units. Useful compositions for this invention would have at least 60 mole % acetal units and no more than 20 mole % of acetate units. The optimal composition would have at least 70 mole % acetal units with the balance being vinyl alcohol units. The glass transition temperature of the optimal polymer would be about 110° C. Poly(vinyl acetal) may be synthesized by reaction of acetaldehyde with poly(vinyl alcohol) such as Vinol 107 ® (Air Products and Chemicals Inc.).

The siloxanes defined above can be employed in the invention herein at any concentration useful for the intended purpose. In general, good results have been obtained at a concentration of about 0.05 to about 1.0 $g/m^2$, preferably about 0.3 to about 0.6 $g/m^2$, with or without a binder.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R FS ® (Mitsubishi Chemical Industries, Ltd.), and Kayalon Polyol Brilliant Blue N BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co. Ltd.); acid dyes such as Kayanol Milling Cyanine 5R ® (Nippon Kayaku Co. Ltd.); basic dyes such as Sumicacryl Blue 6G ® (Sumitomo Chemical Co., Ltd.), and Aizen Malachite Green ® (Hodogaya Chemical Co., Ltd.);

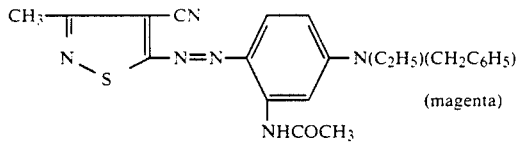

(magenta)

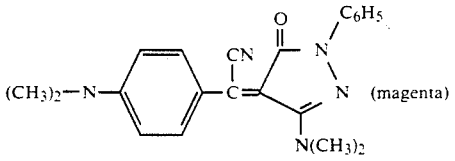

(magenta)

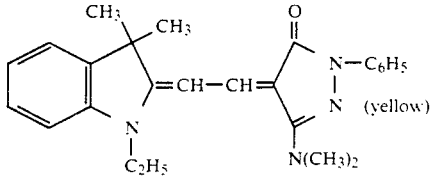

(yellow)

-continued

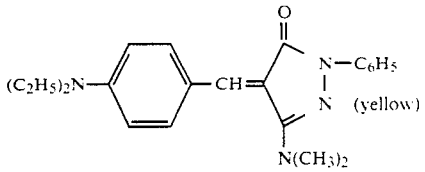

(yellow)

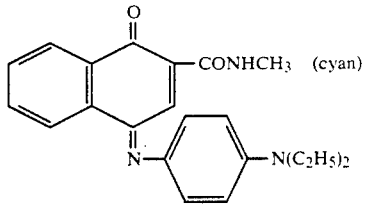

(cyan)

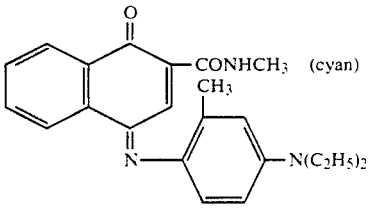

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 $g/m^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm. It may also be coated with a subbing layer, if desired, such as those materials described in U.S. Pat. No. 4,695,288 or U.S. Pat. No. 4,737,486.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek ®.

The dye image-receiving layer may comprise, for example, a polycarbonate, a polyurethane, a polyester, poly(vinyl chloride), poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

EXAMPLE 1

Preparation of Poly(vinyl acetal)

440 g of VINOL 107 ® were added to 5580 g of distilled water and heated to 90° C. for one hour to give a clear solution. The solution was cooled to 10° C., 1300 g of 36% hydrochloric acid was added, and the mixture cooled to 10° C. Acetaldehyde (274 g) was added with vigorous stirring. The mixture was stirred at 10° C. for 10 minutes and became milky; a finely divided precipitate began to be formed. The mixture was stirred at 10° C. for an additional 15 minutes and then warmed and kept 4 hrs. at a temperature of 30° C. The finely divided white solid was filtered off and washed twice for 30 minutes with 4L. of distilled water. The solid was washed a third time with 4L. of distilled water and the pH of the wash was adjusted with 10% sodium hydroxide until a constant pH of 7 was obtained. The solid was collected by filtration and dried in a vacuum oven at 40° C. to give 487 g of a white product. NMR analysis showed the composition to be 75 mole % acetal and 25 mole % vinyl alcohol units.

EXAMPLE 2

Comparison of Slip Layers For Debris Transferred to Thermal Head and Propensity to Produce Scratches in the Printed Copy Poly(vinyl acetal) was compared to cellulose acetate propionate as a binder for the slip layer in the following experiment.

A multicolor dye-donor was prepared by gravure coating on a 6 μm poly(ethylene terephthalate) support:

(1) a subbing layer of titanium alkoxide (DuPont Tyzor TBT) ®(0.13 g/m$^2$) from n-propyl acetate and n-butyl alcohol mixture, and (2) a dye layer containing the first yellow dye illustrated above (0.26 g/m$^2$) and Shamrock S363 N-1 ® polypropylene wax micronized powder (Shamrock Chemicals Corporation) (0.011 g/m$^2$) in a cellulose acetate propionate (2.5% acetyl, 45% propionyl) binder (0.34 g/m$^2$) coated from a toluene, methanol and cyclopentanone solvent mixture.

(3) a dye layer containing the magenta dyes illustrated above (0.15 and 0.14 g/m$^2$ respectively) and Shamrock S363 N-1 ® polypropylene wax micronized powder (Shamrock Chemicals Corporation)(0.11 g/m$^2$) in a cellulose acetate propionate (2.5% acetyl, 45% propionyl) binder (0.26 g/m$^2$) coated from the same solvent mixture as for the yellow dye.

(4) a dye layer containing the cyan dyes illustrated above (0.37 and 0.11 g/m$^2$ respectively) and Shamrock S363 N-1 ® polypropylene wax micronized powder (Shamrock Chemicals Corporation)(0.021 g/m$^2$) in a cellulose acetate propionate (2.5% acetyl, 45% propionyl) binder as above (0.35 g/m$^2$) coated from the same solvent mixture as for the yellow dye above.

On the back side of the dye-donor was coated:

(1) a subbing layer of titanium alkoxide (DuPont Tyzor TBT) ®(0.13 g/m$^2$) from n-propyl acetate and n-butyl alcohol mixture, and (2) a slipping layer containing the amino-propylsilyl-terminated polysiloxane described below (0.011 g/m$^2$) neutralized with 0.0003 g/m$^2$ p-toluenesulfonic acid and the poly(propylene oxide methyl octyl siloxane copolymer BYK 320 (from BYK Chemie, USA) (0.0054-0.0081 g/m$^2$) in the binders each at 0.54 g/m$^2$ indicated below.

PS 513 [aminopropyl-dimethyl-terminated poly(-dimethyl siloxane)]is available commercially from Huls America Inc. (27000 molecular weight and 2000 viscosity).

Control Binder— Cellulose acetate propionate (2.5% acetyl, 45% propionyl) was coated from a toluene, methanol and cyclopentanone mixture.

Invention Binder— Poly(vinyl acetal), 75 mole % acetal and 25 mole % vinyl alcohol units coated using the same solvent mixture as for the control.

A dye-receiving element was prepared by coating the following layers in the order recited on a titanium dioxide-pigmented polyethylene-overcoated paper stock which was subbed with a layer of Dow Z6020®, (an aminoalkyl alkoxy silane from Dow Chemical USA) (0.11 g/m$^2$) coated from ethyl alcohol:

(1) a dye-receiving layer of Makrolon 5700® (Bayer AG Corporation) polycarbonate resin (1.6 g/m$^2$), a bisphenol A polycarbonate as described in U.S. Pat. No. 4,927,803 (1.6 g/m$^2$), diphenyl phthalate (0.32 g/m$^2$), dibutyl phthalate (0.32 g/m$^2$) and surfactant FC-431® (3M Corp.) (0.011 g/m$^2$) coated from methylene chloride.

(2) overcoat layer of a polycarbonate of diethylene glycol (49.7 mole %), bisphenol A (49.8 mole %) and a bis(aminopropyl-terminated)-poly(dimethyl siloxane) (0.5 mole-%) (0.22 g/m$^2$), FC431® surfactant (3M Corp.) (0.032 g/m$^2$) and DC-510® surfactant (Dow Corning) (0.016 g/m$^2$) coated from methylene chloride.

The dye side of the dye-donor element strip, approximately 13 cm ×21 cm in area, was placed in contact with the dye image-receiving layer of the dye-receiver element of the same area. The assemblage was suitably positioned between a 19.8 mm diameter rubber roller and a TDK Thermal Head (No. LV 540A, 1A0008). The head (thermostatted at 30° C) was pressed with a force of 36 N against the dye-donor element side of the assemblage pushing the latter against the rubber roller.

The imaging electronics were activated causing the donor/receiver assemblage to be advanced between the printing head and the roller at 5.0 mm/sec. Coincidentally the resistive elements in the thermal print head were pulsed for 128 msec/pulse at 133 msec intervals during the 17 msec/dot printing time. The voltage supplied to the print head was 13.3 volts, resulting in an instantaneous peak power of 0.047 watts/dot and a maximum total energy of 0.33 mjoules/dot. The printed area was divided into two images approximately equal in size. One was a low-density, continuous tone portrait of an individual, the other image was a stepped density chart consisting of eleven 0.9×1.1 mm steps repeated eight times in a particular pattern.

For the control and for the invention, 25 three-color prints were made. The condition of the heating line of the thermal head was documented by making photomicrographs at 78× magnification at specific points before and after printing the 25 prints. The amount of debris was noted as well as the condition of the surface at the heating line. Next, the effectiveness of cleaning the heating line to remove any debris was assessed. Cleaning was done alternately with acetone and water using a Kimwipe (Kimberly-Clark Corp.) to wipe the heating line. The prints were also visually examined for scratches. The following results were obtained.

TABLE 1

| Slip Layer | Amount of Debris on Heating Line After 25 Prints | Result of Cleaning Heating Line After 25 prints | Scratches Print 25 |
|---|---|---|---|
| CONTROL | heavy; corrosion appeared | residue persisted | 34 |
| INVENTION | light; no corrosion | debris removed | 0 |

TABLE 1-continued

The above results indicate that the slipping layer according to the invention sharply reduced head debris and print scratches in the printing format employed. The slip layer of the invention also did not corrode the head glaze and allowed one to easily clean off the minimal debris found on the heating line.

EXAMPLE 3

Silicone variations, Force Measurement

Three-color dye-donors with poly(vinyl acetal) slipping layers were prepared as described in Example 2 as follows:

| | |
|---|---|
| a) | Invention A slipping layer PS513 at 0.008 g/m$^2$ as only siloxane lubricant present. |
| b) | Invention B slipping layer PS513 at 0.011 g/m$^2$ and BYK S732 at 0.0008 g/m$^2$. |

In the comparative examples (Comparisons 1–6), various silicones were used in place of PS513 in the slipping layer. The slipping layers were coated from 3-pentanone/methanol at 75/25 weight %. BYK S732 was used instead of BYK 320. Only the cyan areas were used for this evaluation. A dye receiver identical to the one described above was also used.

The dye side of the dye-donor element strip, approximately 12.7 cm ×21.6 cm was placed in contact with the dye image receiving layer of the dye receiver element of the same area. The assemblage was placed between a stepper-motor-driven 19.8mm diameter rubber roller and a TDK Thermal Head (LV540A) (thermostatted at 45° C.). The head was pressed with a force of 5.0 kg against the dye-donor element side of the assemblage pushing it against the rubber roller.

The imaging electronics were activated causing the donor-receiver assemblage to be drawn between the printing head and roller at 5 mm/sec. Coincidentally, the resistive elements in the thermal print head were pulsed for 29 g/m$^2$ msec/pulse at 133 msec intervals during the 17 msec/dot printing time. A stepped density image was generated by incrementally increasing the number of pulses/dot from 0 to 128. The voltage supplied to the print head was approximately 13.3 volts, resulting in an instantaneous peak power of 0.047 watts/dot and a maximum total energy of 0.33 mjoules/dot.

As each "area test pattern" of given density was being generated, the force required to move the assemblage between the print head and the roller was measured using an S. Himmelstein Corp. 3-08TL(16-1) Torquemeter R (11.5 cm-kg range and a Model 6-488B Conditioning Module R. Data were obtained at minimum density (0 pulses) (D-min) and at maximum density (128 pulses)(D-max). The following results were obtained:

TABLE 2

| SLIPPING LAYER | RELATIVE FORCE (Kg) D-min | D-max |
|---|---|---|
| Invention A | 0.50 | 0.86 |
| Invention B | 0.45 | 0.68 |
| Comparison 1 | 2.54 | 2.09 |
| Comparison 2 | 1.82 | 2.04 |
| Comparison 3 | stuck to head at Dmax | |
| Comparison 4 | stuck to head at Dmax | |
| Comparison 5 | 1.73 | 1.32 |
| Comparison 6 | 2.45 | 2.36 |
| Comparison 7 | 0.59 | 1.41 |

The polysiloxanes used in conjunction with BYK S732 in Comparisons 1-6 were:

Comparison 1. PS 043 (Huls America), trimethoxysiloxy-terminated polydimethylsiloxane.

Comparison 2. PSW2804 (Huls America), aminopropyldimethyl-terminated poly(methyl phenyl siloxane).

Comparison 3. PS342.5 (Huls America), silanol terminated polydimethylsiloxane.

Comparison 4. PS130 (Huls America), polymethyloctadecylsiloxane.

Comparison 5. PS137 (Huls America), copolymer of (48-58%) methyl phenethyl siloxane and (52-42%) methyl hexyl siloxane.

Comparison 6. PS096.5 (Huls America), dimethylsiloxane-α-methylstyrene block copolymer.

The above materials were coated at 0.011 g/m$^2$ with 0.008 g/m$^2$ BYK S732 (BYK Chemie Corp.) in the slipping layer.

Comparison 7. BYK S732 only at 0.008 g/m$^2$.

The data in Table 2 show the uniqueness of Inventions A and B in that exceptionally low friction was observed with these slipping layers. A number of other polysiloxanes used with BYK S732 showed high friction or simply stuck to the printing head. Comparison 2 showed that not all aminopropyl-terminated polysiloxanes produce low friction like that of the invention. The data also showed that BYK S732 alone did not yield the low friction of the invention particularly when Dmax was printed.

EXAMPLE 4

Variations in Binder Composition

A three-color donor was coated as in Example 2. A receiver was coated as described in Example 1 of U.S. Pat. No. 4,782,041. The friction force of the donor against the printing head was measured as described in Example 1 of U.S. Pat. No. 4,782,041. Slipping layers were coated with poly(vinyl acetal) variations at 0.54 g/m$^2$. PS513 at 0.011 g/m$^2$ and BYK S732 at 0.0081 g/m$^2$ on a Tyzor TBT ® (DuPont Corp.) subbing layer opposite from the dye side of the donor.

Binders A-J are poly(vinyl acetals). A-G were coated from ethyl acetate/methanol (85/15 wt.-%) so were K-M. H-J were coated from methanol/water (95/5 wt. %). K and L were poly(vinyl butyrals) (Butvar-76 and Butvar-98 respectively). Binder M was a poly(vinyl propional). Binder N was Formvar 5/95E poly(vinyl formal) (Monsanto Co.) and was coated from toluene/methanol/water to produce a very hazy nonuniform coating. The cyan dye transfer to the slip layer was measured after heating the dye-donor wound on a 21 mm diameter wooden dowel for 3 days at 60° C. and 70% R.H. The cyan dye transferred to the back of the yellow dye patch was determined by measurement of the total red transmission density and subtracting the red density of the yellow patch. The following results were obtained:

TABLE 3

| Binder | Composition Mole % Acetal | Alcohol | Acetate | Retransfer Density | Friction force (kg) |
|---|---|---|---|---|---|
| A | 75 | 25 | 0 | 0.11 | 0.39 |
| B | 84 | 16 | 0 | 0.04 | 0.38 |
| C | 77 | 15 | 8 | 0.13 | 0.38 |
| D | 64 | 18 | 18 | 0.08 | 0.43 |
| E | 50 | 22 | 28 | 0.32 | 0.37 |
| F | 37 | 29 | 34 | 0.68 | 0.33 |
| G | 65 | 0 | 35 | 0.14 | 0.58 |
| H | 44 | 56 | 0 | 0.04 | 1.95 |
| I | 43 | 44 | 13 | 0.18 | 1.45 |
| J | 31 | 53 | 16 | 0.27 | 1.54 |
| K | 69 | 31 | 0 | 0.66 | 0.36 |
| L | 55 | 45 | 0 | 1.11 | 0.36 |
| M | 63 | 37 | 0 | 0.60 | 0.36 |
| N | 76 | 11 | 14 | 0.07 | 0.43 |

The data in Table 3 show that the best compositions for the poly(vinyl acetal) are those high in acetal units and low in acetate. Such a binder provides a slip layer which shows low friction and minimizes transfer of dye from the dye side to the slip layer during storage at an elevated temperature (60° C.). The data also show that poly(vinyl acetal) is superior to the higher aliphatic polymeric acetals which have much lower glass transition temperatures. Formvar (Monsanto) was inferior to poly(vinyl acetal) because of its limited solubility in organic solvents suitable for gravure coating and its tendency to give hazy nonuniform coatings with the addenda and solvents used here.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising an aminoalkyl(dialkylsilyl)-terminated poly(dialkyl siloxane) in a polymeric binder, the improvement wherein said polymeric binder comprises a poly(vinyl acetal) having more than 60 mole % acetal units which is formed from poly(vinylalcohol) and acetaldehyde or formaldehyde.

2. The element of claim 1 wherein said poly(vinyl acetal) has at least 70 mole % acetal units and the balance being vinyl alcohol units.

3. The element of claim 1 wherein said poly(vinyl acetal) is formed from poly(vinylalcohol) and acetaldehyde.

4. The element of claim 1 wherein said aminoalkyl(dialkylsilyl)-terminated poly(dialkyl siloxane) has the formula:

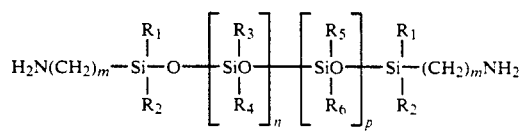

where m is from 3 to 6, n is from 10 to 2,000, p is from 0 to about 2,000 and $R_1$-$R_6$ are alkyl groups having from 1 to about 6 carbon atoms.

5. The element of claim 1 wherein said binder comprises a second siloxane which is a copolymer of a polyalkylene oxide and a methylalkylsiloxane.

6. The element of claim 5 wherein said second siloxane is a copolymer of polypropylene oxide and poly(methyl octyl siloxane).

7. The element of claim 1 wherein said support comprises poly(ethylene terephthalate).

8. In a process of forming a dye transfer image comprising:

(a) imagewise-heating a dye-donor element comprising a support having on one side thereof a dye layer and on the other side a slipping layer comprising an aminoalkyl(dialkylsilyl)-terminated poly(dialkyl siloxane) in a polymeric binder, and (b) transferring a dye image to a dye receiving element to form said dye transfer image, the improvement wherein said polymeric binder comprises a poly(vinyl acetal) having more than 60 mole % acetal units which is formed from poly(vinylalcohol) and acetaldehyde or formaldehyde.

9. The process of claim 8 wherein said poly(vinyl acetal) has at least 70 mole % acetal units and the balance being vinyl alcohol units.

10. The process of claim 8 wherein said poly(vinyl acetal) is formed from poly(vinylalcohol) and acetaldehyde.

11. The process of claim 8 wherein said aminoalkyl(dialkylsilyl)-terminated poly(dialkyl siloxane) has the formula:

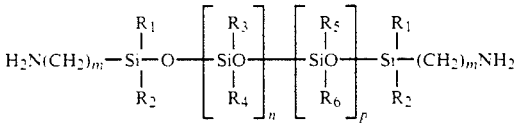

where m is from 3 to 6, n is from 10 to 2,000, p is from 0 to about 2,000 and $R_1$–$R_6$ are alkyl groups having from 1 to about 6 carbon atoms.

12. The process of claim 8 wherein said binder comprises a second siloxane which is a copolymer of a polyalkylene oxide and a methylalkylsiloxane.

13. The process of claim 12 wherein said second siloxane is a copolymer of polypropylene oxide and poly(methyl octyl siloxane).

14. The process of claim 8 wherein said support comprises poly(ethylene terephthalate).

15. In a thermal dye transfer assemblage comprising (a) a dye-donor element comprising a support having on one side thereof a dye layer and on the other side a slipping layer comprising an aminoalkyl(dialkylsilyl)-terminated poly(dialkyl siloxane) in a polymeric binder, and (b) a dye receiving element comprising a support having thereon a dye image-receiving layer, said dye-receiving element being in a superposed relationship with said dye-donor element so that said dye layer is in contact with said dye image-receiving layer, the improvement wherein said polymeric binder comprises a poly(vinyl acetal) having more than 60 mole % acetal units which is formed from poly(vinylalcohol) and acetaldehyde or formaldehyde.

16. The assemblage of claim 15 wherein said poly(vinyl acetal) has at least 70 mole % acetal units and the balance being vinyl alcohol units.

17. The assemblage of claim 15 wherein said poly(vinyl acetal) is formed from poly(vinylalcohol) and acetaldehyde.

18. The assemblage of claim 15 wherein said aminoalkyl(dialkylsilyl)-terminated poly(dialkyl siloxane) has the formula:

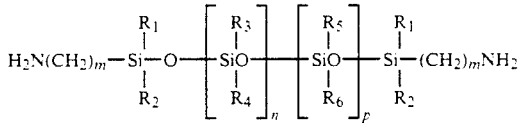

where m is from 3 to 6, n is from 10 to 2,000, p is from 0 to about 2,000 and $R_1$–$R_6$ are alkyl groups having from 1 to about 6 carbon atoms.

19. The assemblage of claim 15 wherein said binder comprises a second siloxane which is a copolymer of a polyalkylene oxide and a methylalkylsiloxane.

20. The assemblage of claim 19 wherein said second siloxane is a copolymer of polypropylene oxide and poly(methyl octyl siloxane).

* * * * *